US007568557B2

(12) United States Patent
Rossignol

(10) Patent No.: US 7,568,557 B2
(45) Date of Patent: Aug. 4, 2009

(54) ELEVATOR CAR WITH CAR ELECTRICAL SYSTEM INTEGRATED IN THE CAR ROOF AND METHOD OF MOUNTING AN ELEVATOR INSTALLATION

(75) Inventor: Eric Rossignol, Dietwil (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/303,423

(22) Filed: Dec. 16, 2005

(65) Prior Publication Data

US 2006/0180408 A1 Aug. 17, 2006

(51) Int. Cl.
*B66B 11/02* (2006.01)
*B66B 7/00* (2006.01)
*B66B 5/00* (2006.01)

(52) U.S. Cl. ..... 187/401; 187/277; 187/298; 187/414

(58) Field of Classification Search ..... 187/401, 187/22, 316, 317, 414, 277, 313, 298, 390, 187/391; 49/373, 463; *B66B 11/02, 13/02, B66B 7/00, 5/00*
See application file for complete search history.

(56) References Cited

U.S. PATENT DOCUMENTS

| | | | | |
|---|---|---|---|---|
| 4,043,430 | A | 8/1977 | Kraft et al. | |
| 6,550,585 | B2 * | 4/2003 | Schoppa et al. | 187/391 |
| 2003/0010576 | A1 * | 1/2003 | Malone, Jr. | 187/390 |

FOREIGN PATENT DOCUMENTS

| | | | |
|---|---|---|---|
| EP | 1174381 | A1 * | 1/2002 |
| FR | 2 695 632 | | 3/1994 |
| JP | 06321465 | A * | 11/1994 |
| JP | 2000016725 | | 1/2000 |

* cited by examiner

*Primary Examiner*—Peter M Cuomo
*Assistant Examiner*—Stefan Kruer
(74) *Attorney, Agent, or Firm*—Fraser Clemens Martin & Miller LLC; William J. Clemens

(57) ABSTRACT

A portion of an elevator car electrical system, such as car computer, terminals, communication apparatus, etc., is mounted in an apparatus space integrated into a car roof. The apparatus space is arranged along a car roof edge and utilizes a constructional height required for stiffening the car roof. The portion of the car electrical system is accessible by a moveable cover for service. When closed, the cover forms a standing surface which can be used for servicing in the elevator shaft.

13 Claims, 2 Drawing Sheets

ELEVATOR CAR WITH CAR ELECTRICAL SYSTEM INTEGRATED IN THE CAR ROOF AND METHOD OF MOUNTING AN ELEVATOR INSTALLATION

BACKGROUND OF THE INVENTION

The present invention relates to an elevator installation with a car electrical system integrated in the car roof and a method for mounting an elevator installation.

The elevator installation comprises an elevator car movable in an elevator shaft. The elevator car essentially consists of a car floor, side walls, at least one car entrance and a car roof. Access to the car takes place in normal operation of the elevator installation by way of a floor entrance and the car entrance.

Different electrical or electromechanical apparatus and installations necessary for operation of the elevator installation are, as a rule, arranged in the region of the car roof. These apparatus and installations are, for example, the door control, evaluating apparatus for shaft information and/or for door monitoring, apparatus for operation of the installation in service operation, communications apparatus, energy storage apparatus, parts of the car lighting and/or cable connections or processors for control of further functional groups. These apparatus and installations form parts of the car electrical system. A service operation serves for moving the car in the shaft for the purpose of maintenance or similar tasks. In the case of service operation the elevator installation can be controlled from the car roof. The control elements necessary for that purpose are similarly arranged in the region of the car roof. Further electrical components such as, for example, display elements, car call transmitters, load measuring sensors or further parts of the car electrical system, such as the door drive or space monitoring sensors, are due to function arranged in further locations on or in the car.

A box fastened to the car roof is shown in the U.S. Pat. No. 4,043,430. The box contains parts of the door drive and offers space for the car electrical system. The box is provided with a removable cover which is constructed to be able to be walked on. The box gives the car roof additional strength. The disadvantage of this solution is:

- The box is placed on the car roof and causes additional constructional height.
- In order to be able to walk on the car roof the box has to be stepped over or steps are formed which hamper the operations and, in particular, walking on the car roof.
- The mounting effort is substantial, since the box is mounted and wired only on assembly of the car at the construction site.
- The cover of the box is removed for the purpose of maintenance. This increases the risk of accident when the maintenance person, with the electrical covering removed, stands on the car or when the cover is not mounted in the case of car journeys which follow.

A car is shown in the Japanese patent specification JP 2000-16725, in which the car electrical system is arranged in part spaces of the car roof. The car electrical system is in that case accessible from above by way of hatches for maintenance or the car electrical system is, for maintenance, accessible from below by folding up the center zone of the car roof or from the car interior. The object of this invention is providing a car roof which does not have any protruding subassemblies of the car electrical system. The disadvantages of this solution are that control of the elevator in service operation is not available and that in the case of an open maintenance hatch the car roof area which can be walked on is small.

SUMMARY OF THE INVENTION

An object of the present invention is to arrange the car electrical system, which is required for operation of the car, in such a manner that control of the car for service operation is possible, that sufficiently large standing areas are present, that it does not cause any additional constructional height, that it can be mounted with low cost and that the risk of accident is reduced as far as possible. In addition, the car electrical system shall be arranged economically and, for the purpose of maintenance, it shall be accessible in simple, safe and rapid manner.

The present invention fulfils this object. As a primary function the car roof closes the passenger space of the car at the top. It accepts the forces which are required for stiffening the entire car body. In the case of self-supporting cars the car roof additionally takes over the necessary force component for transfer of the supporting forces. At the same time it serves for the service personnel as a standing surface in the case of service operations within the shaft. With respect to the passenger space it serves as a carrier of possible roof design elements or itself forms the roof of the car able to be seen by the passengers. In order to be able to take over these primary functions the car roof has to be provided in the requisite strength. For this purpose the car roof is usually executed in the form of a pan. The height of the pan enables construction, appropriately in strength, of the car roof in order to be able to ensure the primary functions. The car roof thereby occupies a car roof space which is defined by the plan area of the car roof or of the car multiplied by the pan height of the car roof. A part of the thereby created car roof space is used for arrangement of parts of the car electrical system. This part of the car roof space is termed apparatus space.

According to the present invention the apparatus space which is used for arrangement of parts of the car electrical system is now arranged along an outer boundary of the car roof or along a car roof edge. The car roof space has in the region of the car roof edge the fastening points required for fastening parts of the car electrical system. The car roof space given by the construction of the roof is thereby utilized in an optimum manner and no additional constructional space is required. The mounting cost for the car electrical system is substantially reduced, since the car roof can be wired and equipped with the car electrical system at the factory in the most suitable environment. The corresponding cost in the field is eliminated and the cost-efficiency of the product is improved particularly also because the car electrical system can be largely checked with respect to function in the factory.

The apparatus space or the region of the car roof containing the car electrical system is preferably arranged along a lateral boundary of the car roof, wherein this lateral boundary usually extends at right angles to the boundary which is associated with the main car entrance. The lateral arrangement means that the apparatus space, considered from a floor access, is arranged at the left-hand or right-hand boundary edge of the car roof. The car roof can thereby be easily walked on, for the purpose of maintenance, with use of a floor entrance, since no large parts of the car electrical system are arranged in the region of the main entrance opening and the car roof can thereby be freely walked on. The region of the car roof which is constructed for accommodation of the car electrical system is advantageously confined to a region which is less than ⅓ of the corresponding car dimension or comprises less than ⅓ of the car roof area. If the car electrical system is arranged at a lateral boundary of the car roof, the apparatus space used for accommodation of the car electrical system advantageously occupies less than ⅓ of the car width. Due to this arrangement, the rest of the car roof area has a sufficient standing area in order to be able to offer a sufficiently large, unified work area for the service specialist.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
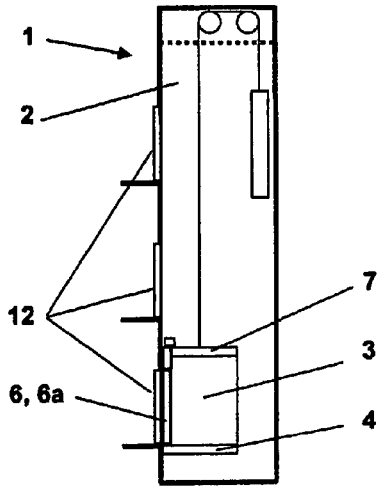
FIG. 1 is a schematic side elevation view of an elevator installation including an elevator car with a car roof according to the present invention.

An elevator installation 1 consists, as illustrated in FIG. 1 by way of example, of an elevator car 3 which is arranged in an elevator shaft 2 to be movable along a substantially vertical axis. The elevator car 3 serves primarily for the movement of persons and/or goods. The elevator car 3 consists of a car floor 4, side walls 5*a*, 5*b*, a front wall containing a car entrance 6, a back wall and a car roof 7. The access to the elevator car 3 is made possible via at least one of the car entrance 6 and via floor entrances 12. If the elevator car 3 has more than one car entrance 6, a main car entrance 6*a* is defined. The elevator car 3 is, in the illustrated example, connected with a counterweight by means of support means and moved by means of a drive. The arrangement of the drive is not critical for this invention and the elevator car can, in addition, be executed in the form of a self-propelled vehicle.

Figure 2:
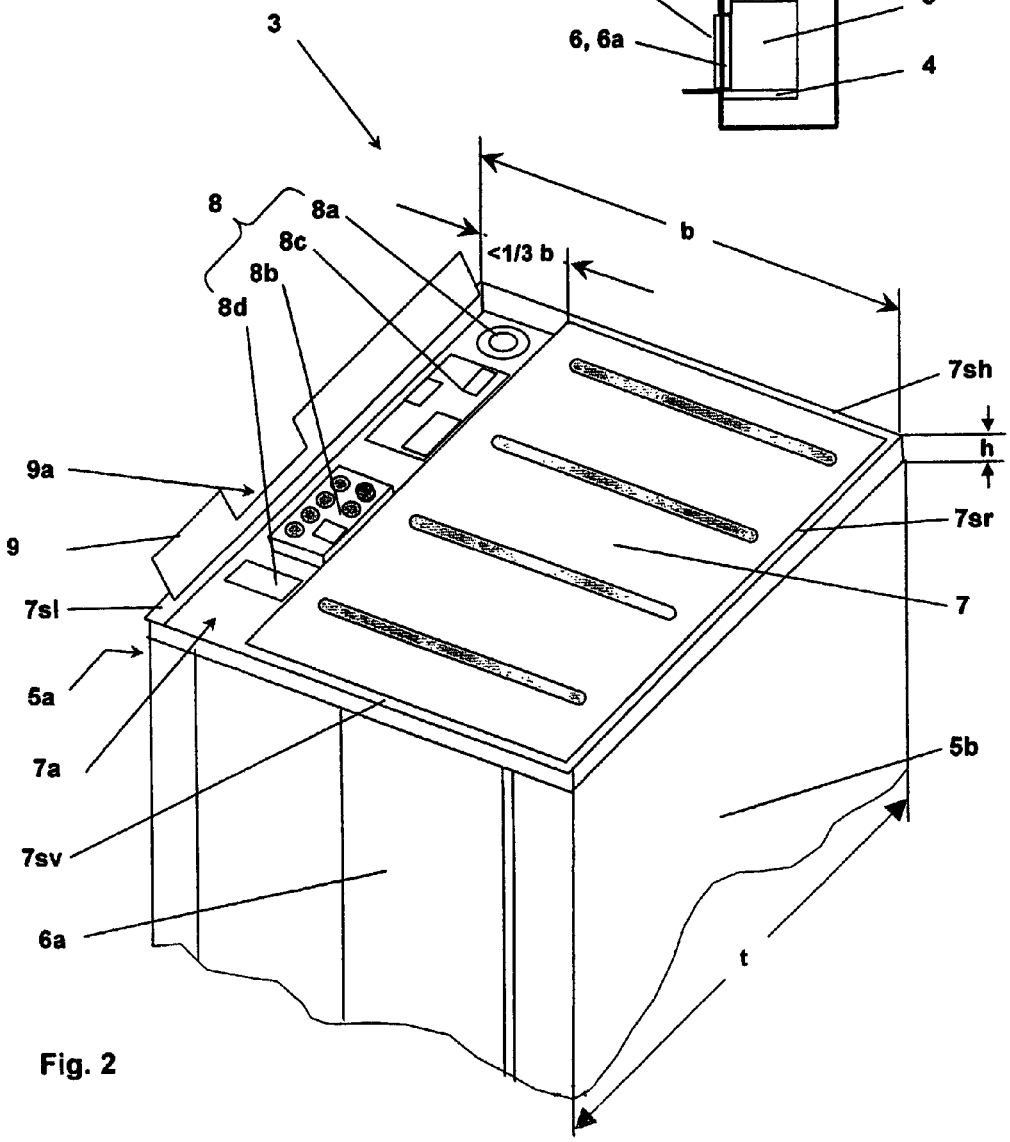
FIG. 2 is a perspective view of the car roof shown in FIG. 1 with a laterally arranged apparatus space.
Figure 3:
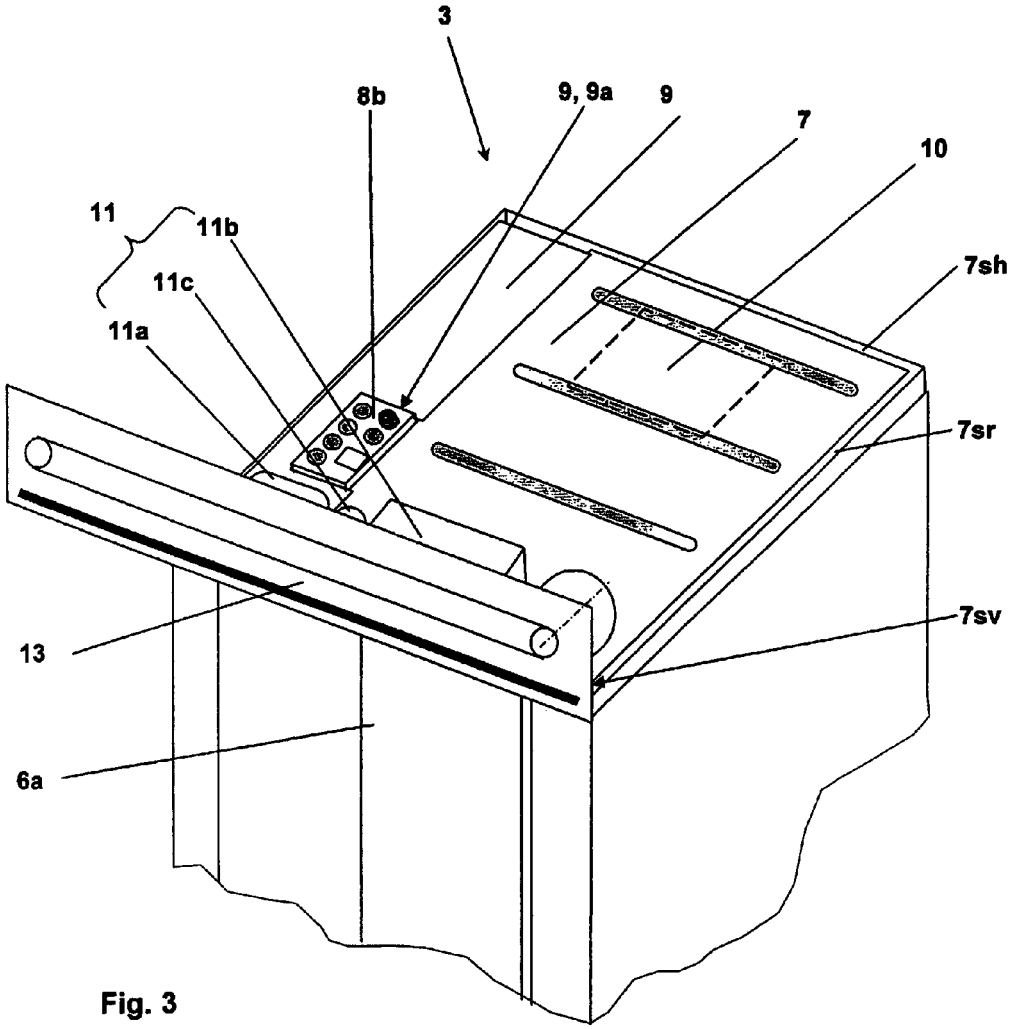
FIG. 3 is a perspective view of the car roof shown in FIG. 2 with the laterally arranged apparatus space closed and a further car electrical system mounted.

The car roof 7 closes the elevator car 3, as shown in FIGS. 2 and 3, at the top. The car roof 7 can be walked on for the purpose of maintenance. In the illustrated example, the car roof has a height "h" of seven to twelve centimeters (cm). The lateral boundaries of the car roof 7 are formed by car roof edges 7*sh*, 7*sl*, 7*sr* and 7*sv*. The car roof 7 is closed towards the passenger space. This side serves for reception of ceiling design elements according to the selection of the customer. The cover, which is usually closed downwardly, upwardly forms, together with the car roof edges 7*sh*, 7*sl*, 7*sr* and 7*sv* a pan which has the height "h" of the car cover. This pan forms a car roof space which corresponds with the product of the height "h", a width "b" times a depth "t" (h×b×t). This car roof space is divided up into part spaces. An apparatus space 7*a* is, according to the present invention, arranged along the car roof edge 7*sl* (or one of 7*sh*, 7*sr* and 7*sv*) or along an outer boundary of the car roof 7. The apparatus space 7*a* can in that case, depending on the mode of construction of the car roof 7, be selectably arranged along the rear car roof edge 7*sh*, along the front car roof edge 7*sv* or along one of the lateral car roof edges 7*sl*, 7*sr*. Parts of a car electrical system 8 required for operation of the car are arranged in the apparatus space 7*a*. The car electrical system 8 includes, for example, apparatus and installations such as a car computer 8*c*, which ensures the data communication from the car to the elevator control, a door computer 8*a*, which checks the safety status of the door, communications elements 8*d*, which, for example, serve for alarm transmission, terminals and cable plug positions, as well as stowage space for excess lengths of cables or energy supply units, etc. Similarly, control elements 8*b* which serve for control of the elevator in the service operation are arranged in the apparatus space 7*a* in correspondence with requirements.

The disposition of the apparatus space 7*a* for arrangement of the car electrical system along an outer boundary of the car roof allows an economic construction of the car electrical system 8, since separate boxes do not have to be used. The rest of the car roof space can advantageously be used for stiffening the car roof or for accommodation of car lighting, etc. The arrangement of the car electrical system 8 in the apparatus space 7*a* allows an optimum and economic manufacture of the entire car roof 7 at the factory. It can be wired and checked there as a unit. Mounting at the construction site is thereby optimized and the susceptibility to error due to erroneous wiring is reduced.

In an advantageous embodiment the apparatus space 7*a* used for arrangement of parts of the car electrical system 8 is arranged along the lateral boundary 7*sl*, 7*sr* of the car roof, wherein this lateral boundary 7*sl*, 7*sr* extends at right angles to the boundary associated with the main car entrance 6*a*. The apparatus space 7*a*, which from the viewing direction of the main entrance 6*a* to the car 3 or to the car roof is arranged to the left of 7*sl* or to the right of 7*sr* along a lateral boundary line of the car roof, for reception of the car electrical system 8 fulfils the criterion of easy accessibility. Walking on the car roof 7 is possible without obstruction and risk of accident is reduced.

For example, the apparatus space 7*a* used for arrangement of parts of the car electrical system 8 occupies less than ⅓ of the car roof area. A sufficiently large residual area of the car roof 7 therefore remains available to provide a required work standing surface for the service engineer. In the example shown in FIG. 2 the apparatus space 7*a* for installation of the car electrical system 8 extends substantially over the entire depth "t" of the car and requires, in width, approximately ¼ of the car width or approximately 100 mm to 300 mm. These dimensions offer sufficient space for arrangement of the car electrical system 8 and at the same time enable an optimum construction, which is appropriate to strength, of the car roof 7.

The apparatus space 7*a* receiving the car electrical system 8 can be covered by a cover 9. The cover 9 is advantageously fixedly connected with the car roof 7 by means of a joint along one side. The cover 9 can be opened by means of a pivot motion, as shown in FIG. 2. The car electrical system 8 is thereby protected in the closed state of the cover 9 (FIG. 3) and is easily and safely accessible in the opened state (FIG. 2) for the purpose of maintenance. Moreover, the cover 9 forms a direct protection of the car electrical system 8 during transport of the car roof 7 from the factory to the construction site. Other forms of opening such as, for example, a slidable cover or a removable cover are equally possible according to the choice of the manufacturer.

The closed position of the cover 9 is advantageously monitored electrically. The monitoring prevents release of the elevator installation 1 for normal operation as long as the cover 9 is not disposed in the closed setting. The safety for maintenance specialists is thereby additionally increased. In the case of need the cover 9 can be locked in the closed setting (FIG. 3). This prevents improper access to the car electrical system 8 and thus precludes, inter alia, vandalism and damage.

The cover 9 is advantageously constructed to be able to be walked on. It has the stiffness necessary for this purpose and in the case of need is executed with a slip-proof structure, such as, for example, a grooved plate as defined in the standard DIN 59220. The service specialist can use the surface formed by the roof as an additional standing surface. It is constructed to be slip-resistant and tread-safe. In addition, the cover 9 in the closed state is advantageously arranged in one plane with respect to the rest of the car roof. The service specialist thereby has, when the cover 9 is closed, the entire car roof area 7 available as a work platform and he or she can carry out the service operations, which are required in the shaft, safely and in a convenient standing position. Since the closed cover does not form a step to the rest of the car roof the risk of an accident as a consequence of tripping is reduced.

In FIG. 3 it is apparent that the rest of the car plan area is used for arrangement of an emergency escape 10. The illustrated arrangement of the emergency escape 10 allows safe evacuation of passengers, who are trapped in the elevator car, by way of the car roof 7. Such an emergency escape is desired in specific cases by, for example, the elevator standard EN-81.

As apparent in FIGS. 2 and 3, the cover 9 used for covering the car electrical system 8 has a cut-out 9*a* which enables access to the control elements 8*b* or other elements, which are required for the service operation, without the cover 9 having to be opened. A service of the elevator installation, in particular inspection of the shaft space, can thereby be carried out quickly. Dangerous states are avoided, since the current-conducting parts of the car electrical system 8 remain covered. This arrangement of the control elements 8*b* in the apparatus space 7*a* similarly allows an optimum and economic manufacture of the entire car roof 7 at the factory. It can be largely wired and checked there as a unit. Mounting at the construction site is thereby optimized and the susceptibility to error by erroneous wiring is reduced.

A further car electrical system 11, which due to function or for operational reasons is mounted outside the apparatus space 7*a*, is arranged along the car roof edge 7*sv* (or 7*sl*, 7*sr*, 7*sh*). The further car electrical system 11 contains, for example, parts which serve for the direct control or drive 11*b* of a car door and/or lighting elements 11*a* which serve for illumination of the service region for the service specialist and/or monitoring elements 11*c* which in the case of presence of persons on the car roof interrupt normal operation of the elevator installation. This arrangement possibility is particularly advantageous, since the apparatus can be arranged in a suitable position in correspondence with its function and the arrangement along a car roof edge has an insignificant influence on the standing area for the service personnel. As an ideal mounting installation use is made of the car boundary 7*sv* defined by a door drive 13. Above all, the further car electrical system 11*b* serving for drive of the door is thus arranged appropriately to function in the vicinity of its use location.

With knowledge of the present invention the expert can change as desired the set magnitudes and arrangements. For example, the expert can make multiple subdivision of the car roof space, the expert can provide further part regions with a cover in correspondence with purpose or the apparatus space can, in the case of the lateral arrangement, extend only over a part region of the car depth.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator car movable in an elevator shaft of an elevator installation, the car including a car floor, side walls, at least one car entrance and a car roof, the car roof forming a pan with a closed bottom, the car roof comprising:

an apparatus space integrated in the pan, said apparatus space occupying only a portion of the pan and being positioned along a lateral boundary of the car roof, wherein said lateral boundary of the car roof forms a boundary of said apparatus space and said apparatus space is accessible for maintenance from a top of the pan, wherein said apparatus space extends substantially over an entire depth of the car roof from a front boundary of the car roof to a rear boundary of the car roof;

a portion of a car electrical system mounted in said apparatus space, wherein said portion of the car electrical system includes control elements for the elevator installation for at least one of controlling service operation, switching from normal to service operation, and enabling connection of service tools; and a movable cover for selectively closing said apparatus space, wherein said movable cover extends in a plane of a top of the car roof when said cover is closed.

2. The elevator car according to claim 1 wherein said lateral boundary extends at right angles to a boundary associated with a main car entrance of the elevator car and said apparatus space is arranged along a left-hand or a right-hand boundary of the car roof as viewed from said main car entrance.

3. The elevator car according to claim 2 wherein said apparatus space occupies less than ⅓ of an area of the car roof.

4. The elevator car according to claim 2 wherein said cover is openable for access to said portion of the car electrical system mounted in said apparatus space.

5. The elevator car according to claim 2 wherein said cover has a cut-out which enables access to one of said control elements without said cover having to be opened, wherein said one control element is required for service operation.

6. The elevator car according to claim 2 including a further portion of the car electrical system being mounted on the car roof outside said apparatus space.

7. The elevator car according to claim 4 wherein said cover is one of pivotally attached to, slidingly mounted on and removably mounted on the car roof.

8. The elevator car according to claim 6 wherein said further portion of the car electrical system includes at least one of parts for direct control or drive of a car door, lighting elements for illuminating a service region for a service specialist, and monitoring elements which in the case of presence of a person on the car roof interrupt normal operation of the elevator installation.

9. An elevator installation having an elevator car movable in an elevator shaft comprising:

a car floor;

side walls attached to said car floor;

at least one car entrance attached to said car floor and said side walls;

a car roof attached to said side walls and said at least one car entrance to form an elevator car, said car roof forming a car roof space with a closed bottom and said car roof space having a width defined by an entrance boundary of said car roof associated with said at least one car entrance of said elevator car, a depth defined by a lateral boundary of said car roof, and a height, said car roof further including an apparatus space integrated in said car roof space, said apparatus space occupying a portion of said car roof space and being positioned along said lateral boundary of said car roof, whereby said lateral boundary of said car roof forms a boundary of said apparatus space and extends at right angles to said entrance boundary associated with said at least one car entrance of said elevator car, said apparatus space extending over substantially an entirety of said depth of said car roof from a front boundary of the car roof to a rear boundary of the car roof and being arranged along a left-hand or right-hand boundary of said car roof as viewed from said at least one car entrance, said apparatus space being accessible for maintenance purposes from a top of said car roof space;

a portion of a car electrical system mounted in said apparatus space, wherein said portion of the car electrical system includes control elements for the elevator installation for at least one of controlling service operation, switching from normal to service operation, and enabling connection of service tools; and a movable cover for selectively closing said apparatus space, wherein said movable cover extends in a plane of said top of said car roof when said cover is closed.

10. The elevator car according to claim 9 wherein said cover has a cut-out which enables access to one of said control elements without said cover having to be opened, wherein said one control element is required for service operation.

11. The elevator car according to claim 10 including electrically monitoring a closed position of said cover and preventing a release of the elevator installation for normal operation as long as said cover is not disposed in the closed position.

12. An elevator car movable in an elevator shaft of an elevator installation, the car including a car floor, side walls, at least one car entrance and a car roof, the car roof forming a pan with a closed bottom, the car roof comprising:

an apparatus space integrated in the pan, said apparatus space occupying only a portion of the pan and being positioned along a lateral boundary of the car roof, wherein said lateral boundary of the car roof forms a boundary of said apparatus space and said apparatus space is accessible for maintenance from a top of the pan;

a portion of a car electrical system mounted in said apparatus space, wherein said portion of the car electrical system includes control elements for the elevator installation for at least one of controlling service operation, switching from normal to service operation, and enabling connection of service tools; and a movable cover for selectively closing said apparatus space, wherein said movable cover extends in a plane of a top of the car roof when said cover is closed, wherein said cover is openable for access to said portion of the car electrical system mounted in said apparatus space and said cover has a cut-out which enables access to one of said control elements, which said one control element is required for service operation without said cover having to be opened.

13. An elevator installation having an elevator car movable in an elevator shaft comprising:

a car floor;

side walls attached to said car floor;

at least one car entrance attached to said car floor and said side walls;

a car roof attached to said side walls and said at least one car entrance to form an elevator car, said car roof forming a car roof space with a closed bottom and said car roof space having a width defined by an entrance boundary of said car roof associated with said at least one car entrance of said elevator car, a depth defined by a lateral boundary of said car roof, and a height, said car roof further including an apparatus space integrated in said car roof space, said apparatus space occupying a portion of said car roof space and being positioned along said lateral boundary of said car roof, whereby said lateral boundary of said car roof forms a boundary of said apparatus space and extends at right angles to said entrance boundary associated with said at least one car entrance of said elevator car, said apparatus space extending over substantially an entirety of said depth of said car roof and being arranged along a left-hand or right-hand boundary of said car roof as viewed from said at least one car entrance, said apparatus space being accessible for maintenance purposes from a top of said car roof space;

a portion of a car electrical system mounted in said apparatus space, wherein said portion of the car electrical system includes control elements for the elevator installation for at least one of controlling service operation, switching from normal to service operation, and enabling connection of service tools; and a movable cover for selectively closing said apparatus space, wherein said movable cover extends in a plane of said top of said car roof when said cover is closed, wherein said cover is openable for access to said portion of the car electrical system mounted in said apparatus space and said cover has a cut-out which enables access to one of said control elements, which said one control element is required for service operation without said cover having to be opened.

* * * * *

UNITED STATES PATENT AND TRADEMARK OFFICE

CERTIFICATE OF CORRECTION

PATENT NO. : 7,568,557 B2
APPLICATION NO. : 11/303423
DATED : August 4, 2009
INVENTOR(S) : Eric Rossignol It is certified that error appears in the above-identified patent and that said Letters Patent is hereby corrected as shown below:

Cover Page, insert item -- [60] This application is a CON or PCT/CH04/00196 03/31/2004 --

Cover Page, insert item -- [30] Priority Document:
EUROPEAN PATENT OFFICE (EPO) 03015047.8 07/03/2003 --

Signed and Sealed this

Twentieth Day of October, 2009

David J. Kappos

David J. Kappos
*Director of the United States Patent and Trademark Office*